US007161535B2

(12) United States Patent
Palmer et al.

(10) Patent No.: US 7,161,535 B2
(45) **Date of Patent: *Jan. 9, 2007**

(54) ELECTRICALLY SMALL DIELECTRIC ANTENNA WITH WIDE BANDWIDTH

(75) Inventors: Tim John Palmer, Cambridge (GB); Scott William Spencer Tyler, Cambridge (GB); Sarah Wilson, Newcastle-upon-Tyne (GB); Simon Philip Kingsley, Cambridge (GB)

(73) Assignee: Antenova Ltd., Cambridge (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/524,488
(22) PCT Filed: Aug. 14, 2003
(86) PCT No.: PCT/GB03/03546

§ 371 (c)(1),
(2), (4) Date: Feb. 14, 2005
(87) PCT Pub. No.: WO2004/017461

PCT Pub. Date: Feb. 26, 2004

(65) Prior Publication Data

US 2005/0242996 A1 Nov. 3, 2005

(30) Foreign Application Priority Data

Aug. 14, 2002 (GB) ..... 0218820.9

(51) Int. Cl.
*H01Q 1/38* (2006.01)
*H01Q 15/08* (2006.01)
(52) U.S. Cl. ..... 343/700 MS; 343/911 R
(58) Field of Classification Search ..... 343/700 MS, 343/846, 753, 911 R
See application file for complete search history.

(56) References Cited

U.S. PATENT DOCUMENTS 4,755,820 A 7/1988 Backhouse et al.
4,980,694 A 12/1990 Hines
5,453,754 A 9/1995 Frey
5,541,616 A 7/1996 Kawahata et al.
5,581,262 A 12/1996 Kawahata et al.
5,952,972 A * 9/1999 Ittipiboon et al. ... 343/700 MS
6,031,503 A 2/2000 Preiss, II et al.
6,104,349 A 8/2000 Cohen
6,184,833 B1 2/2001 Tran
6,198,450 B1 * 3/2001 Adachi et al. ..... 343/753
6,323,824 B1 * 11/2001 Heinrichs et al. ..... 343/846

(Continued)

FOREIGN PATENT DOCUMENTS

EP 0217426 4/1987

(Continued)

OTHER PUBLICATIONS

U.S. Appl. No. 09/431,548, filed Oct. 29, 1999, Kinglsey et al.

(Continued)

*Primary Examiner*—Tan Ho
(74) *Attorney, Agent, or Firm*—Pearl Cohen Zedek LLP

(57) ABSTRACT

A dielectric antenna comprising a dielectric element mounted on a first side of a dielectric substrate, a microstrip feed located on the first side of the substrate and extending between the substrate and the dielectric element, and a conductive layer formed on a second side of the substrate opposed to the first, wherein an aperture is formed in the conductive layer at a location corresponding to that of the dielectric element. The antenna is electrically small, has wide bandwidth and good gain characteristics, is efficient and not easily detuned.

20 Claims, 6 Drawing Sheets

U.S. PATENT DOCUMENTS

| | | | | |
|---|---|---|---|---|
| 6,333,719 | B1 | 12/2001 | Varadan et al. | |
| 6,337,666 | B1 | 1/2002 | Bishop | |
| 6,384,785 | B1 | 5/2002 | Kamogawa et al. | |
| 6,452,565 | B1 | 9/2002 | Kingsley et al. | |
| 6,801,164 | B1 * | 10/2004 | Bit-Babik et al. | 343/700 MS |
| 6,819,287 | B1 | 11/2004 | Sullivan et al. | |
| 2001/0054978 | A1 | 12/2001 | Adachi et al. | |
| 2002/0000938 | A1 | 1/2002 | Hoashi et al. | |
| 2002/0101382 | A1 | 8/2002 | Konishi et al. | |
| 2005/0225499 | A1 * | 10/2005 | Kingsley et al. | 343/911 R |
| 2005/0242996 | A1 | 11/2005 | Palmer et al. | |

FOREIGN PATENT DOCUMENTS

| | | |
|---|---|---|
| EP | 0762539 | 3/1997 |
| EP | 0767510 | 4/1997 |
| EP | 0801436 | 10/1997 |
| EP | 0 801 436 | 2/2000 |
| EP | 0801436 | 2/2000 |
| EP | 0982799 | 3/2000 |
| GB | 2 046 530 | 11/1980 |
| GB | 2046530 | 11/1980 |
| GB | 064877 | 6/1981 |
| GB | 2268626 | 1/1984 |
| GB | 2 360 133 | 9/2001 |
| GB | 2 377 556 | 1/2003 |
| GB | 2 386 475 | 9/2003 |
| GB | 2393039 | 3/2004 |
| JP | 01144801 | 6/1989 |
| JP | 2257702 | 10/1990 |
| JP | 07249927 | 9/1995 |
| JP | 09/172306 | 6/1997 |
| JP | 09172306 | 6/1997 |
| JP | 10163738 | 6/1998 |

OTHER PUBLICATIONS

Ittipiboon, A., Mongia, R.K., Antar, Y.M.M., Bhartia, P. and Cuhaci, M.: "Aperture Fed Rectangular and Triangular Dielectric Resonators for use as Magnetic Dipole Antennas", Electronics Letters, 1993, 29, (23), pp. 2001-2002.

Kingsley, S.P. and O'Keefe, S.G., "Beam steering and monopulse processing of probe-fed dielectric resonator antennas", IEE Proceedings—Radar Sonar and Navigation, 146, 3, 121-125, 1999.

Leung, K.W.: "Simple results for conformal-strip excited hemispherical dielectric resonator antenna", Electronics Letters, 2000, 36, (11).

Long, S.A., McAllister, M.W., and Shen, L.C.: "The Resonant Cylindrical Dielectric Cavity Antenna", IEEE Transactions on Antennas and Propagallon, AP-31, 1983, pp. 406-412.

McAllister, M.W., Long, S.A. and Conway G.L.: "Rectangular Dielectric Resonator Antenna", Electronics Letters, 1983, 19, (6), pp. 218-219.

Mongia, R.K. and Bhartia, P.: "Dielectric Resonator Antennas—A Review and General Design Relations for Resonant Frequency and Bandwidth", International Journal of Microwave and Millimetre-Wave Computer-Aided Engineering, 1994, 4, (3), pp. 230-247.

Mongia, R.K., Ittipiboon, A., Antar, Y.M.M., Bhartia, P. and Cuhaci, M: "A Hall-Split Cylindrical Dietectric Resonator Antenna Using Slot-Coupling", IEEE Microwave and guided Wave Letters, 1993, vol. 3, No. 2, pp. 38-39.

Petosa, A., Ittipiboon, A., Antar, Y.M.M., Roscoe, D., and Cuhaci, M.: "Recent advances In Dielectric-Resonator Antenna Technology", IEEE Antennas and Propagation Magazine, 1998, 40, (3), pp. 35-48.

Tam, M.T.K. and Murch, R.D.: "Half volume dielectric resonator antenna designs", Electronics Letters, 1997, 33, (23), pp. 1914-1916.

International Search Report for International Application No. PCT/GB 03/03546.

Leung, K.W. et al "Annular Slot-Coupled Dielectric Resonator Antenna," Electronic Letters Jun. 25, 1998 vol. 34 No. 13.

Leung, K.W., et al "Low-Profile Circular Disk DR Antenna of Very High Permittivity Excited by a Microstripline," Electronic Letters, Jun. 5, 1997, vol. 33, No. 12.

Leung, K.W. "Simple Result for Conformal-strip Excited Hemispherical Dielectric Resonator Antenna" Electronics Letters, May 25, 2000 vol. 36 No. 11.

Luk, K.M. et al "Technique for Improving Coupling Between Microstripline and Dielectric Resonator Antenna" Electronics Letters Mar. 4, 1999 vol. 35 No. 5.

Guo, Y.X , et al. "Mutual Coupling Between Rectangular Dielectric Resonator Antennas by FDTD" IEE Proc -Microw Antennas Propag. vol. 146 No. 4 Aug. 1999.

Search and Examination Report for GB 0415923 2, date is not available.

Leung K W, et al. "Low Profile Circular Disk DR Antenna of Very High Permittivity Excited By a Microstipline." Electronics Letters, IEE Stevenage, GB, vol. 33, No. 12, Jun. 5, 1997, pp. 1004-1005, XP0067576. Issn: 0013-5194. Figure 1.

Luk K M, et al. "Technique for Improving Coupling Between Microstripline and Dielectric Resonator Antenna." Electronics Letters, IEE Stevenage, GB, vol. 35, No. 5, Mar. 4, 1999, pp. 357-358, XP006011858. Issn: 0013-5194. Figure 2.

Petosa, A., Ittipiboon, A., Antar, Y.M.M., Roscoe, D., and Cuhaci, M.: "Recent Advances in Dielectric-Resonator Antenna Technology", IEEE Antennas and Propagation Magazine, 1998, 40, (3), pp. 35-48.

Leung, K.W.: "Simple Results for Conformal-Strip Excited Hemispherical Dielectric Resonator Antenna", Electronics Letters, 2000, 36, (11).

Tam, M.T.K. and Murch, R.D.: "Half Volume Dielectric Resonator Antenna Designs", Electronics Letters, 1997, 33. (23), pp. 1914-1916.

Office Action dated Mar. 7, 2006 Appl. No. 10/514,108.

Ittipiboon, A., Mongia, R.K.,Antar, Y.M.M., Bhartia,P. and Cuhaci, M.: "Aperture Fed Rectangular and Triangular Dielectric Resonators for use as Magnetic Dipole Antennas", Electronics Letters, 1993, 29, (23), pp. 2001-2002.

Kingsley, S.P. and O'Keefe, S.G., "Beam steering and monopulse processing of probe-fed dielectric resonator antennas", IEE Proceedings—Radar Sonar and Navigation, 146, 3, 121-125, 1999.

Long, S.A., McAllister, M.W., and Shen, L.C.: "The Resonant Cylindrical Dielectric Cavity Antenna", IEEE Transactions on Antennas and Propagation, AP-31, 1983, pp. 406-412.

McAllister, M.W., Long, S.A. and Conway G.L.: "Rectangular Dielectric Resonator Antenna", Electronics Letters, 1983, 19, (6), pp. 218-219.

Mongia, R.K. and Bhartia, P.: "Dielectric Resonator Antennas—A Review and General Design Relations for Resonant Frequency and Bandwidth", International Journal of Microwave and Millimetre-Wave Computer-Aided Engineering, 1994, 4, (3), pp. 230-247.

Mongia, R.K., Ittipiboon, A., Antar, Y.M.M., Bhartia, P. and Cuhaci, M: "A Half-Split Cylindrical Dielectric Resonator Antenna Using Slot-Coupling", IEEE Microwave and guided Wave Letters, 1993, vol. 3, No. 2, pp. 38-39.

Petosa A, et al. "Bandwith improvement for a microstrip-fed series array of dielectric resonator antennas." Electronics Letters, IEE Stevenage, GB, vol. 32, No. 7, Mar. 28, 1996, pp. 608-609, XP006004963. Issn: 0013-5194, Figure 1.

* cited by examiner

ELECTRICALLY SMALL DIELECTRIC ANTENNA WITH WIDE BANDWIDTH

PRIOR APPLICATION DATA

The present application is a national phase application of International Application PCT/GB2003/003546, entitled "An Electrically Small Dielectric Antenna With Wide Bandwidth" filed on Aug. 14, 2003, which in turn claims priority from application 0218820.9, filed on Aug. 14, 2002, both of which being incorporated by reference in their entirety.

FIELD OF THE INVENTION

The present invention relates to a dielectric antenna having a feed and a groundplane having an aperture, the dielectric antenna having wide bandwidth.

BACKGROUND OF THE INVENTION

Dielectric antennas are devices that radiate or receive radio waves at a chosen frequency of transmission and reception, as used in for example in mobile telecommunications. In general, a dielectric antenna consists of a volume of a dielectric material disposed on or close to a grounded substrate, with energy being transferred to and from the dielectric material by way of monopole probes inserted into the dielectric material or by way of monopole aperture feeds provided in the grounded substrate (an aperture feed is a discontinuity, generally rectangular in shape, although oval, oblong, trapezoidal 'H' shape, '<->' shape, or butterfly/bow tie shapes and combinations of these shapes may also be appropriate, provided in the grounded substrate where this is covered by the dielectric material. The aperture feed may be excited by a strip feed in the form of a inicrostrip transmission line, grounded or ungrounded coplanar transmission line, triplate, slotline or the like which is located on a side of the grounded substrate remote from the dielectric material). Direct connection to and excitation by a microstrip transmission line is also possible. Alternatively, dipole probes may be inserted into the dielectric material, in which case a grounded substrate may not be required. By providing multiple feeds and exciting these sequentially or in various combinations, a continuously or incrementally steerable beam or beams may be formed, as discussed for example in the present applicant's U.S. patent application Ser. No. 09/431,548 now U.S. Pat. No. 6,452,565 and the publication by KINGSLEY, S. P. and O'KEEFE, S. G., "Beam steering and monopulse processing of probe-fed dielectric resonator antennas", IEE Proceedings—Radar Sonar and Navigation, 146, 3, 121–125, 1999, the full contents of which are hereby incorporated into the present application by reference.

The resonant characteristics of a dielectric antenna depend, inter alia, upon the shape and size of the volume of dielectric material, the shape, size and position of the feeds thereto and also on the shape, size and position of the groundplane. It is to be appreciated that in a dielectric antenna, it is the dielectric material that radiates when excited by the feed. This is to be contrasted with a dielectrically loaded antenna (DLA), in which a traditional conductive radiating element is encased in a dielectric material that modifies the resonance characteristics of the radiating element. As a further distinction, a DLA has either no, or only a small, displacement current flowing in the dielectric whereas a dielectric resonator antenna (DRA) or high dielectric antenna (HDA) has a non-trivial displacement current.

Dielectric antennas may take various forms, a common form having a cylindrical shape or half- or quarter-split cylindrical shape. The dielectric medium can be made from several candidate materials including ceramic dielectrics.

Dielectric resonator antennas (DRAs) were first studied systematically in 1983 [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412]. Since then, interest has grown in their radiation patterns because of their high radiation efficiency, good match to most commonly used transmission lines and small physical size [MONGIA, RK and BHARTIA, P.: "Dielectric Resonator Antennas—A Review and General Design Relations for Resonant Frequency and Bandwidth", International Journal of Microwave and Millimetre-Wave Computer-Aided Engineering, 1994, 4, (3), pp 230–247]. A summary of some more recent developments can be found in PETOSA, A., ITTIPIBOON, A., ANTAR, Y. M. M., ROSCOE, D., and CUHACI, M.: "Recent advances in Dielectric-Resonator Antenna Technology", EEE Antennas and Propagation Magazine, 1998, 40, (3), pp 35–48.

A variety of basic shapes have been found to act as good dielectric resonator structures when mounted on or close to a ground plane (grounded substrate) and excited by an appropriate method. Perhaps the best known of these geometries are:

Rectangle [McALLISTER, M. W., LONG, S. A. and CONWAY G. L.: "Rectangular Dielectric Resonator Antenna", Electronics Letters, 1983, 19, (6), pp 218–219].

Triangle [ITTIPIBOON, A., MONGIA, R. K, ANTAR, Y. M. M., BHARTIA, P. and CUHACI, M.: "Aperture Fed Rectangular and Triangular Dielectric Resonators for use as Magnetic Dipole Antenmas", Electronics Letters, 1993, 29, (23), pp 2001–2002].

Hemisphere [LEUNG, K. W.: "Simple results for conformal-strip excited hemispherical dielectric resonator antenna", Electronics Letters, 2000, 36, (11)].

Cylinder [LONG, S. A., McALLISTER, M. W., and SHEN, L. C.: "The Resonant Cylindrical Dielectric Cavity Antenna", IEEE Transactions on Antennas and Propagation, AP-31, 1983, pp 406–412].

Half-split cylinder (half a cylinder mounted vertically on a ground plane) [MONGIA, R. K., ITTIPBOON, A., ANTAR, Y. M. M., BHARTIA, P. and CUHACI, M: "A Half-Split Cylindrical Dielectric Resonator Antenna Using Slot-Coupling", IEEE Microwave and guided Wave Letters, 1993, Vol. 3, No. 2, pp 38–39].

Some of these antenna designs have also been divided into sectors. For example, a cylindrical DRA can be halved [TAM, M. T. K. and MURCH, R. D.: "Half volume dielectric resonator antenna designs", Electronics Letters, 1997, 33, (23), pp 1914–1916]. However, dividing an antenna in half, or sectoring it further, does not change the basic geometry from cylindrical, rectangular, etc.

High dielectric antennas (HDAs) are similar to DRAs, but instead of having a full ground plane located under the dielectric resonator, HDAs have a smaller ground plane or no ground plane at all. DRAs generally have a deep, well-defined resonant frequency, whereas HDAs tend to have a less well-defined response, but operate over a wider range of frequencies. HDAs can take the same variety of preferred shapes as DRAs. However, any arbitrary dielectric shape can be made to radiate and this can be useful when trying to design the antenna to be conformal to its casing.

In both DRAs and HDAs, the primary radiator is the dielectric resonator. In DLAs the primary radiator is a conductive component (e.g. a copper wire or the like) and the dielectric modifies the medium in which the antenna operates, and generally makes the antenna smaller.

DETAILED DESCRIPTION OF THE DRAWINGS

For a better understanding of the present invention and to show how it may be carried into effect, reference shall now be made by way of example to the accompanying drawings, in which.

DETAILED DESCRIPTION OF TILE INVENTION

Figure 1:
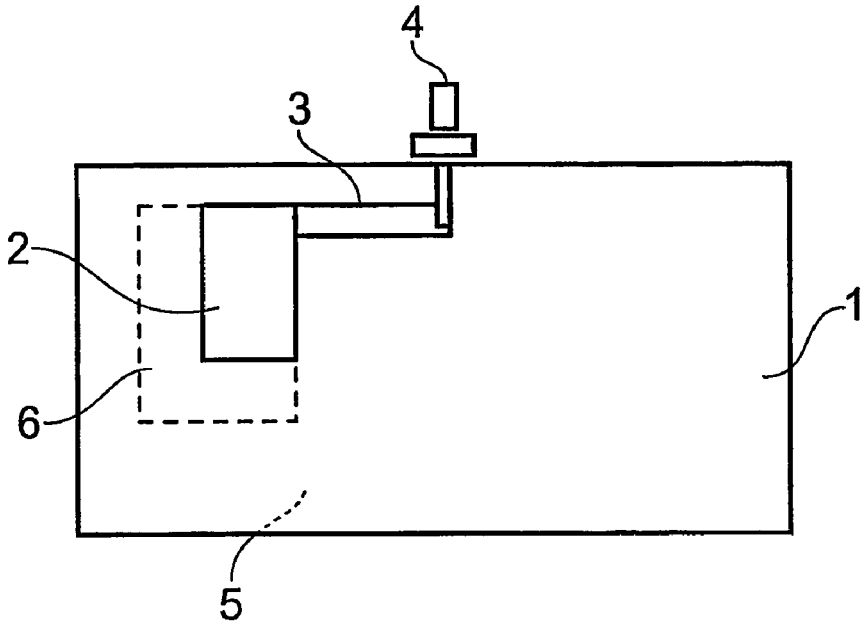
FIG. 1 is a schematic plan view of a first embodiment of the first aspect of the present invention.

For the purposes of the present application, the expression "dielectric antenna" is hereby defined as encompassing DRAs, HDAs and DLAs (since some embodiments of the present invention may be thought of as non-uniformly loaded monopoles).

According to a first aspect of the present invention, there is provided a dielectric antenna comprising a dielectric element mounted on a first side of a dielectric substrate, a microstrip feed located on the first side of the substrate and extending between the substrate and the dielectric element, and a conductive layer formed on a second side of the substrate opposed to the first, wherein an aperture is formed in the conductive layer at a location corresponding to that of the dielectric element.

Embodiments of the present invention are electrically small, have wide bandwidth and good gain characteristics, are efficient and are not easily detuned.

Embodiments of the present invention are particularly well suited as mobile telephone handset antennas, where increasingly wide bandwidths are required to cover the extra functionality that modern handsets need for operations at 3G (third generation) and Bluetooth® bands as well as existing GSM bands.

The conductive layer on the second side of the substrate may act as a groundplane for the antenna of embodiments of the present invention.

The aperture in the conductive layer is preferably greater in area than a surface of the dielectric element that faces or contacts the first side of the substrate. The aperture may be rectangular in shape or any other appropriate shape. The aperture may have a similar or substantially identical shape to that of the surface of the dielectric element that contacts the first side of the substrate, or may have a different shape.

The dielectric resonator may be a piece of low-loss dielectric ceramics material, and is preferably oblong or rectangular in shape, a half-split cylinder, or a half-split cylinder with its curved surface ground down so as to be substantially flattened. Other shapes and configurations, such as quarter-split cylindrical, are not excluded. It has been found that embodiments of the present invention work well with different dielectric ceramics materials having different dielectric constants. While it is generally preferred that at least parts of the dielectric element contact the first side of the substrate, embodiments of the present invention may still function correctly when the dielectric element is mounted close to the substrate but not directly touching the substrate. For example, where the microstrip feed is not completely flush with the first side of the substrate and the dielectric element is mounted on top of the microstrip feed, there may be a small air gap between a surface of the dielectric element facing the first side of the substrate and the first side of the substrate itself. The gap may be bridged with dielectric pads or strips or other dielectric filling material, or possibly with conductive pads or strips or other conductive filling material.

The microstrip feed advantageously passes between the dielectric element and the first side of the substrate at or towards one end of the dielectric element. Preferably, the microstrip feed has a substantially linear extension in a vicinity of the dielectric element, the substantially linear extension being disposed substantially orthogonal to a major axis of the dielectric element.

The microstrip feed line may extend only part way across a width of the dielectric element, or may extend across a full width of the dielectric element, or may even extend beyond a fall width of the dielectric element. Although the best performance from the antenna of embodiments of the present invention has been observed when the microstrip feed is disposed as described above, it has been found by experimentation that other feed shapes do work, including feeds that bend or curl round under the dielectric element, or are 'L' shaped, 'U' shaped, etc. under the dielectric element and are not orthogonal to the major axis of the dielectric element at every point.

The aperture in the conductive layer need not be surrounded on all sides by conductive material For example, the aperture may be formed at an edge or corner of a substrate or may extend across a full width of a substrate. However, it is generally preferred for the aperture to be surrounded on all sides by conductive material.

It has been found that for any particular shape or configuration of dielectric element, there is an optimum or near-optimum size for the aperture.

Increasing a width of the slot (i.e. in a direction of extension of the microstrip feed) tends to increase the bandwidth of the dielectric antenna Increasing a length of the slot (i.e. in a direction generally orthogonal to the extension of the microstrip feed) tends to improve a frequency match, but does raise the resonant or operational frequency of the dielectric antenna.

The present applicant has found that the presence of the aperture in the conductive layer is crucial for exceptionally wide bandwidth performance. However, it has been found by experimentation that part of the aperture can be 'filled in' by conducting material on either or both surfaces, provided that such conducting material does not touch the main groundplane. Further, when the aperture runs across a top edge of the substrate so that it has only one boundary with the main groundplane and when the aperture is filled in with conducting material on the same side as the groundplane with just a small gap between the two, then the width of the gap is crucial to obtaining a good return loss (a good match to 50 ohms). The return loss is poor for a gap of 0.5 mm, fair for a gap of 2 mm and good for a gap greater than 5 mm.

Prototypes of embodiments of the present invention have been constructed using a printed circuit board substrate material as the dielectric substrate, and copper as the conductive layer. It will be clear that other materials with appropriate characteristics may be used. It has been found that the antenna of embodiments of the present invention works well for different types of substrates having different thicknesses and different dielectric constants.

It has also been found that the dielectric element can be placed on the second surface of the substrate, i.e. on the same side as the aperture. In this configuration it is more like conventional slot feeding, but with a much larger slot or aperture than is customarily used.

According to a second aspect of the present invention, there is provided a dielectric antenna comprising a microstrip feed located on a first side of a dielectric substrate, a conductive layer formed on a second side of the substrate opposed to the first and having an aperture formed therein, and a dielectric element mounted oni a second side of the substrate within or at least overlapping the aperture.

In some embodiments of both the first and the second aspects of the present invention, the surface of the dielectric element facing or contacting the first or second side of the dielectric substrate may be provided with a conductive coating or layer, e.g. by way of metallisation. This helps during manufacture of the antenna, since the dielectric element can be attached to the appropriate surface of the dielectric substrate and/or the microstrip feed by way of reflow or reflux soldering. Alternatively or in addition, one or more other surfaces of the dielectric element may be provided with a conductive coating or layer, e.g. by way of metallisation.

Referring to FIG. 1, there is shown a dielectric substrate 1 in the form of a PCB, on a first surface of which is mounted a low-loss dielectric ceramics pellet 2 formed as a half-split cylinder with its curved face ground down to leave a flat top surface. A microstrip feed line 3 extends across the first surface of the substrate 1 from an SMA connector 4 and passes between the pellet 2 and the first surface of the substrate 1. It can be seen that the microstrip feed line 3 is substantially orthogonal to a major axis of the pellet 2 and passes thereunder at one end thereof A second surface of the substrate 1, opposed to the first surface, is provided with a conductive metal layer 5, except in a region underneath the pellet 2 where an aperture 6 is defined by an absence of conductive material 5.

A prototype dielectric antenna has been constructed with a pellet 2 having a length of 18.2 mm, a height of 5.8 mm and a width of 8 mm; the pellet 2 being mounted on a PCB 1 having a length of 80 mm, a width of 35 mm and a thickness (depth) of 1.6 mm. A layer of copper has been used as the conductive layer 5. In one embodiment, the aperture 6 has a length of 35 mm (corresponding to the width of the PCB 1) and a width of 14 mm; in another embodiment, the aperture 6 has a length of 35 mm and a width of 13.5 mm.

Typical performance figures for the prototype dielectric antenna described above are shown in Table 1:

TABLE 1

| | Min Frequency | Centre Frequency | Max Frequency | Measurement Level | Bandwidth % | Gain |
|---|---|---|---|---|---|---|
| S11 | 1444 MHz | 1837 MHz | 2230 MHz | VSWR 3:1 | 43% | N/A |
| S21 | 1250 MHz | 1790 MHz | 2330 MHz | −3 dB | 60% | 3.3 dBi |

The results show that the $S_{11}$ return loss bandwidth and the $S_{21}$ transmission bandwidth are both remarkably large for such a small antenna having good gain (3.3 dBi).

Figure 2:
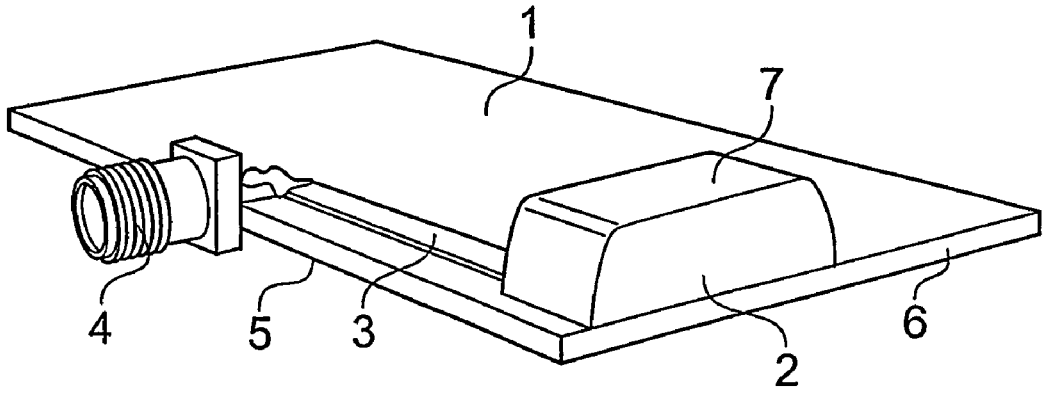
FIG. 2 is a perspective view of the embodiment of FIG. 1.

FIG. 2 shows an alternative view of the embodiment of FIG. 1, with like parts being labelled as in FIG. 1. The flattened top surface 7 of the pellet 2 is clearly shown.

Figure 3:
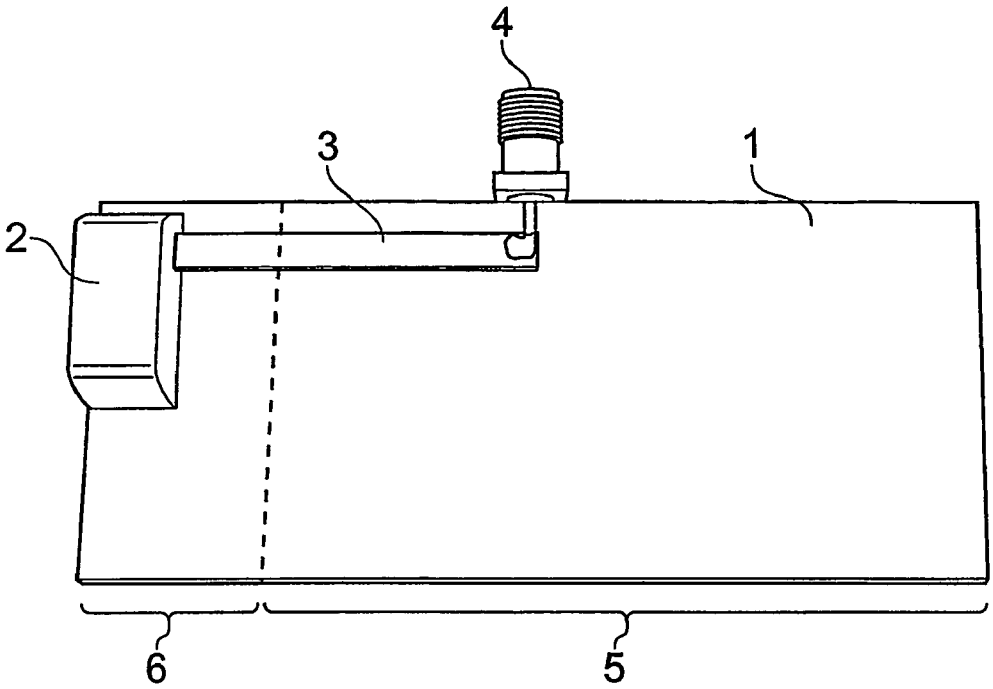
FIG. 3 is a plan view of a second embodiment of the first aspect of the present invention.

FIG. 3 shows an alternative embodiment of the present invention where the aperture 6 extends across a whole width of the substrate 1.

Figure 4:
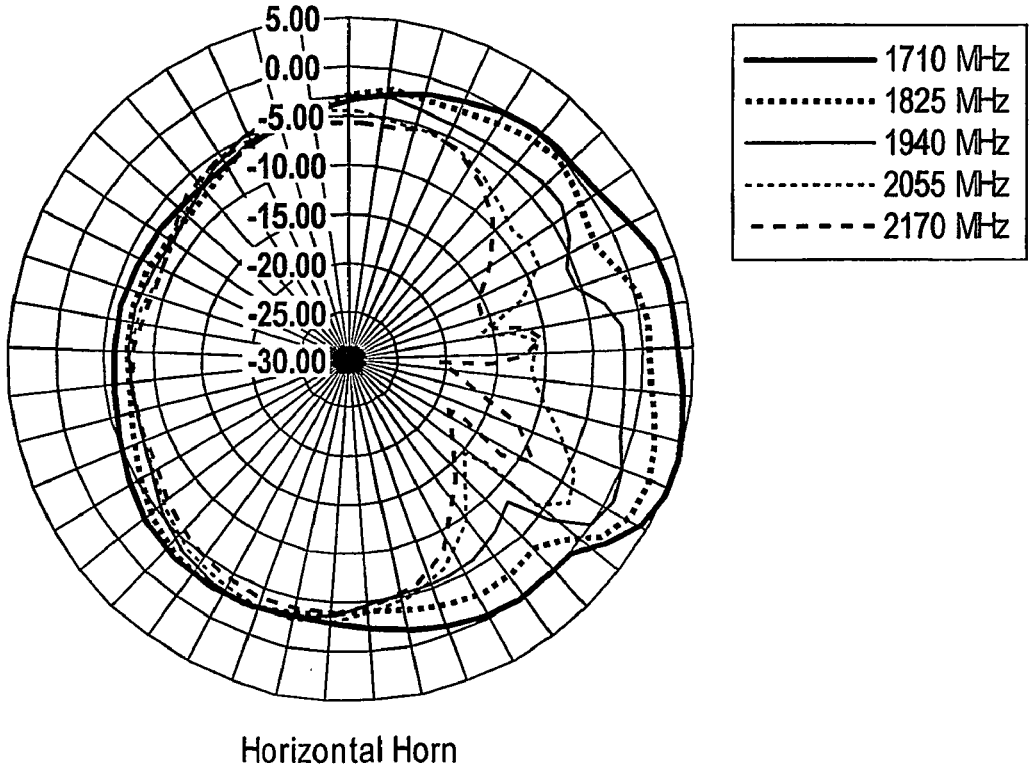
FIG. 4 is a plot of a vertical elevation radiation pattern for the embodiment of FIG. 1.
Figure 5:
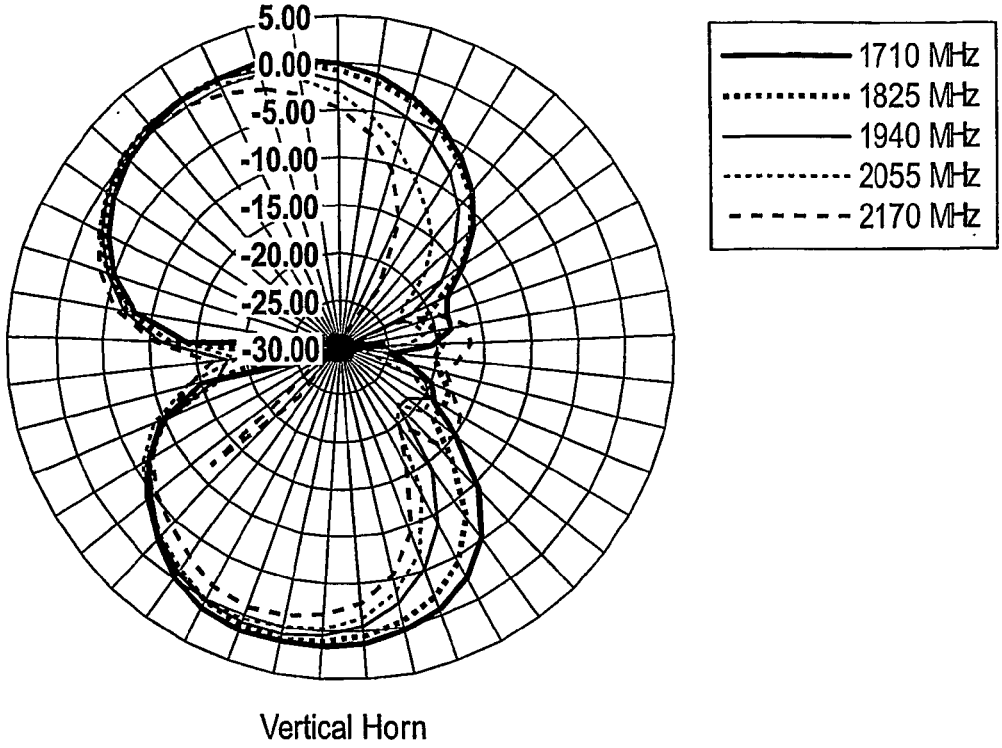
FIG. 5 is a plot of a horizontal elevation radiation pattern for the embodirnent of FIG. 1.
Figure 6:
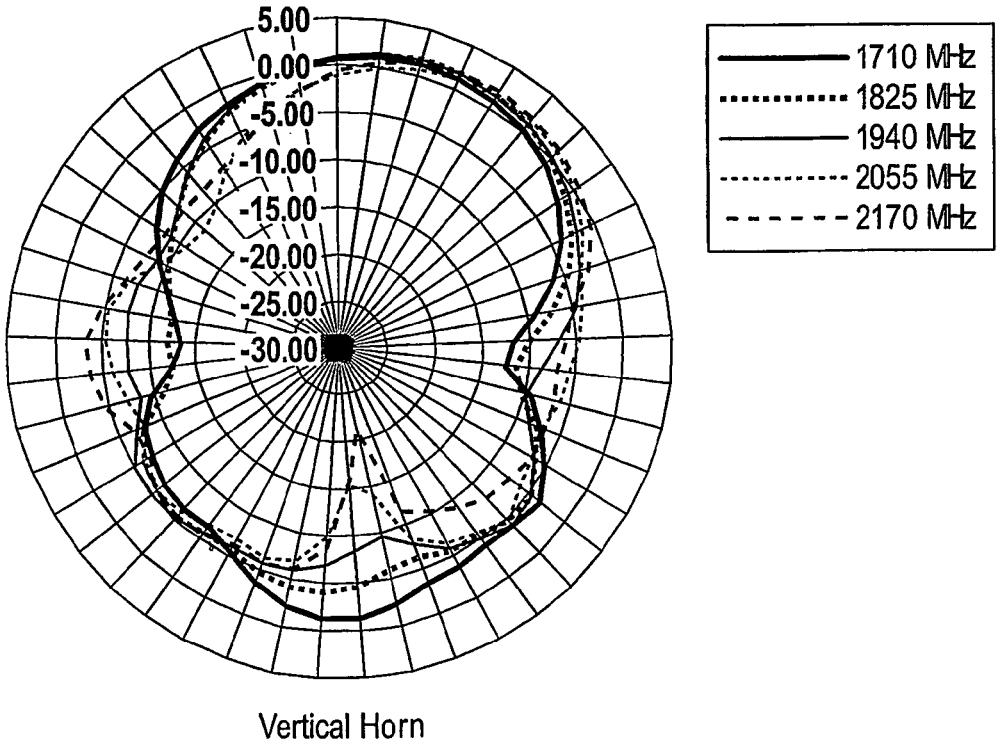
FIG. 6 is a plot of an azimuth radiation pattern for the embodiment of FIG. 1.

FIGS. 4, 5 and 6 respectively show vertical elevation, horizontal elevation and azimuth radiation patterns for the embodiment of FIG. 1 at various frequencies. It can be seen that useful gain is obtained across a frequency band from 1710 to 2170 MHz. This frequency band encompasses the European 1800 MHz, US 1900 MHz and WCDMA mobile telephone frequency bands.

Figure 7:
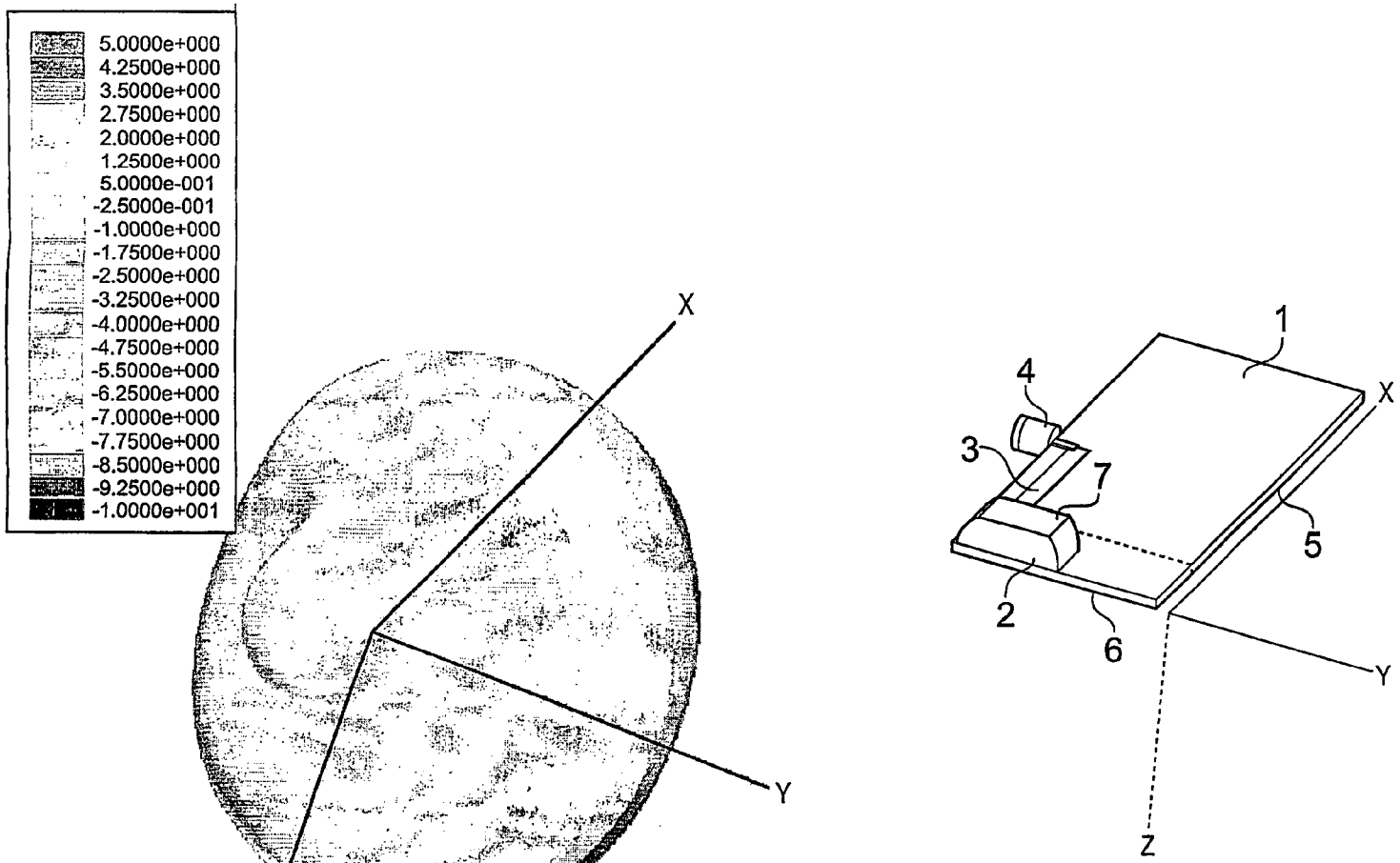
FIG. 7 shows a computer-simulated 3D radiation pattern for a third embodiment of the first aspect of the present invention, also shown in FIG. 7.

The dielectric antenna of the present invention has been simulated using Ansofti HFSS electromagnetic simulation software. The simulation confims that the dielectric antenna radiates effectively over a wide bandwidth and that the results are not merely a measurement artefact arising due to radiation from cables, microstrips and the like. FIG. 7 shows a simulation of a 3D radiation pattern at 1940 MHz, which is in general agreement with measured patterns at that frequency. FIG. 7 also shows a schematic of the simulated dielectric antenna, with parts being labelled as in FIG. 1.

Figure 8:
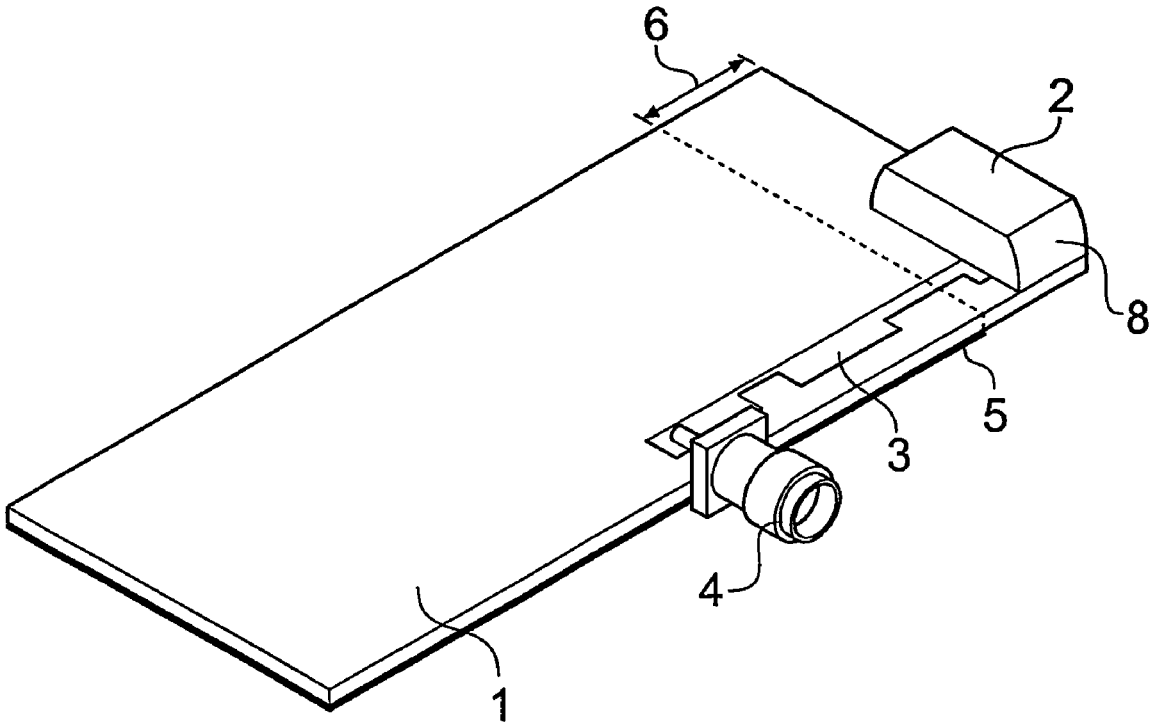
FIG. 8 shows an alternative to the embodiments of FIGS. 1, 2 and 3 in which an underside of the dielectric element is provided with a conductive coating or layer.

FIG. 8 shows an alternative embodiment to those of FIGS. 1, 2, 3 and 7, comprising a dielectric PCB substrate 1 with a dielectric ceramics pellet 2 mounted on a first surface of the substrate 1. A microstrip feedline 3 extends across the first surface of the substrate 1 from an SMA connector 4 and passes between the pellet 2 and the substrate 1. A second surface of the substrate 1 is provided with a conductive metal layer 5 which acts as a groundplane, except in a region underneath the pellet 2 where an aperture 6 is defined by an absence of conductive material 5. In contrast to the embodiments of FIGS. 1, 2, 3 and 7, the dielectric pellet 2 is provided on its underside with a metal layer or coating 8, which contacts the microstrip feedline 3 and the first surface of the dielectric substrate 1. The metal layer or coating 8 allows the pellet 2 to be attached to the substrate 1 by reflow or reflux soldering, which allows for quick and simple manufacture of the antenna and for a robust physical connection between the pellet 2 and the substrate 1.

Figure 9:
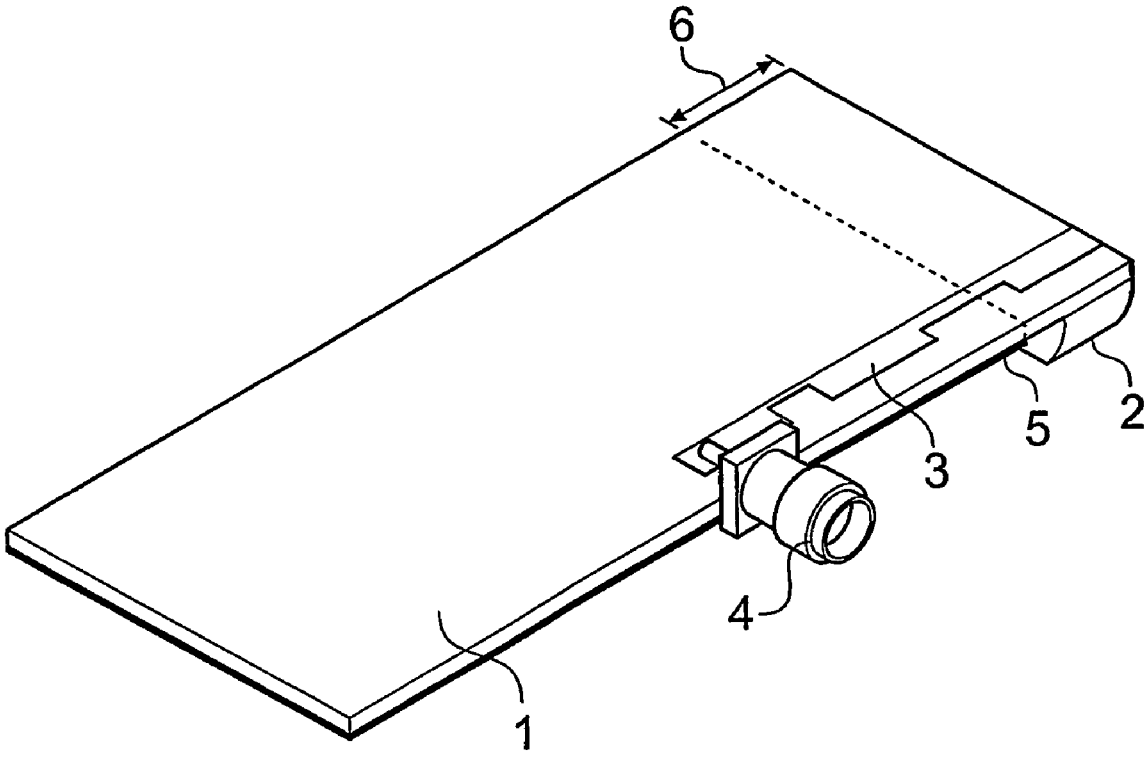
FIG. 9 shows an embodiment of the second aspect of the present invention.

FIG. 9 shows an embodiment of the second aspect of the present invention, in which there is provided a dielectric PCB substrate 1 with a metal layer 5 provided on its underside except for an aperture 6 defined by an absence of the conductive metal layer 5. A microstrip feed 3 is located on a topside of the substrate 1, extending from an SMA connector 4 to a region of the topside corresponding to a location of the aperture 6 in the metal layer 5 on the underside of the substrate 1. In contrast to the embodiments of FIGS. 1, 2, 3 and 7, the low-loss dielectric ceramics pellet 2 is mounted on the underside of the substrate 1 in the aperture 6. The dielectric antenna of this embodiment could be considered to be operating in a slot-fed manner, but with a much larger slot or aperture 6 than is conventionally used. Indeed, in the embodiment shown, the slot or aperture 6 is wider than the pellet 2.

The preferred features of the invention are applicable to all aspects of the invention and may be used in any possible combination.

Throughout the description and claims of this specification, the words "comprise" and "contain" and variations of the words, for example "comprising" and "comprises", mean "including but not limited to", and are not intended to (and do not) exclude other components, integers, moieties, additives or steps.

The invention claimed is:

1. A dielectric antenna comprising a dielectric element mounted on a first side of a dielectric substrate, a microstrip feed located on the first side of the substrate and extending between the substrate and the dielectric element, and a conductive layer formed on a second side of the substrate opposed to the first, wherein an aperture is formed in the conductive layer at a location corresponding to that of the dielectric element.

2. An antenna as claimed in claim 1, wherein the aperture is surrounded on all sides by the conductive layer.

3. An antenna as claimed in claim 1, wherein the aperture extends to at least one edge or corner of the second side of the substrate and is thus not surrounded on all sides by the conductive layer.

4. An antenna as claimed in claim 1, wherein the dielectric element is made of a low-loss dielectric ceramics material.

5. An antenna as claimed in claim 1, wherein the dielectric element is oblong or rectangular in shape.

6. An antenna as claimed in claim 1, wherein the dielectric element is half-split or quarter-split cylindrical in shape.

7. An antenna as claimed in claim 1, wherein edge regions or curved surfaces of the dielectric element are chamfered or flattened by grinding.

8. An antenna as claimed in claim 1, wherein the aperture has a shape similar to that of a surface of the dielectric element facing or contacting the dielectric substrate.

9. An antenna as claimed in claim 1, wherein the aperture has a shape different from that of a surface of the dielectric element facing or contacting the dielectric substrate.

10. An antenna as claimed in claim 1, wherein the microstrip feed passes between the dielectric element and the first side of the substrate at or towards one end of the dielectric element.

11. An antenna as claimed in claim 1 wherein the dielectric element has a major axis and a minor axis substantially parallel to the substrate, these axes respectively defining a length and a width of the dielectric element.

12. An antenna as claimed in claim 11, wherein the microstrip feed has a substantially linear extension which is substantially orthogonal to the major axis in a vicinity of the dielectric element.

13. An antenna as claimed in claim 11, wherein the microstrip feed extends only part way across the width of the dielectric element.

14. An antenna as claimed in claim 11, wherein the microstrip feed extends across the entire width of the dielectric element.

15. An antenna as claimed in claim 11, wherein the microstrip feed extends beyond the entire width of the dielectric element.

16. An antenna as claimed in claim 1, wherein the microstrip feed is curved, bent or curled in a vicinity of the dielectric element.

17. An antenna as claimed in claim 1, wherein the aperture is partially filled with a conducting material that does not contact the conductive layer.

18. An antenna as claimed in claim 1, wherein the dielectric element is provided with a conductive coating or layer on at least one surface thereof.

19. An antenna as claimed in claim 18, wherein the at least one surface is a surface of the dielectric element that faces or contacts the dielectric substrate.

20. A dielectric antenna comprising a microstrip feed located on a first side of a dielectric substrate, a conductive layer formed on a second side of the substrate opposed to the first and having an aperture formed therein, and a dielectric element mounted on a second side of the substrate within or at least overlapping the aperture, wherein the aperture is greater in area than a surface of the dielectric element facing or contacting the dielectric substrate.

* * * * *